US007153545B2

(12) United States Patent
Gouret

(10) Patent No.: US 7,153,545 B2
(45) Date of Patent: Dec. 26, 2006

(54) METHOD OF MASKING, MASKING STRIP SUITED TO THE METHOD AND METHOD OF MANUFACTURING SAID STRIP

(75) Inventor: Jean-Louis Gouret, Beine Nauroy (FR)

(73) Assignee: Saint-Gobain Abrasifs Technologie et Services, Aubervilliers (FR)

( * ) Notice: Subject to any disclaimer, the term of this patent is extended or adjusted under 35 U.S.C. 154(b) by 158 days.

(21) Appl. No.: 10/867,732

(22) Filed: Jun. 16, 2004

(65) Prior Publication Data

US 2004/0234691 A1 Nov. 25, 2004

Related U.S. Application Data

(62) Division of application No. 10/067,418, filed on Feb. 7, 2002, now abandoned.

(30) Foreign Application Priority Data

Feb. 7, 2001 (FR) ..... 01 01625

(51) Int. Cl.

| | |
|---|---|
| ***B05D 1/32*** | (2006.01) |
| ***B05D 7/14*** | (2006.01) |
| ***B05B 15/04*** | (2006.01) |
| ***B05C 21/00*** | (2006.01) |

(52) U.S. Cl. ..... 427/282; 156/293; 428/317.3; 428/317.7; 428/313

(58) Field of Classification Search ..... 427/282; 156/293; 428/317.3, 317.7, 343, 355 RA
See application file for complete search history.

(56) References Cited

U.S. PATENT DOCUMENTS

| | | | | |
|---|---|---|---|---|
| 4,714,633 | A | 12/1987 | Horki et al. | |
| 5,540,880 | A | 7/1996 | Horiki et al. | |
| 2002/0160115 | A1* | 10/2002 | Gouret | 427/282 |

FOREIGN PATENT DOCUMENTS

| | | |
|---|---|---|
| CH | 640 303 | 12/1983 |
| DE | 296 01 846 | 4/1996 |
| EP | 0 365 510 A1 | 4/1990 |
| EP | 0 384 626 A2 | 8/1990 |
| GB | 494 712 | 10/1938 |
| GB | 2 223 425 | 4/1990 |

* cited by examiner

*Primary Examiner*—Daniel Zirker
(74) *Attorney, Agent, or Firm*—Oblon, Spivak, McClelland, Maier & Neustadt, P.C.

(57) ABSTRACT

A method of masking at least one edge of a part of a surface that is to be treated, especially in a vehicle, includes the steps of using an adhesive masking strip made of an elongate cellular material resistant to a surface treatment and at least one adhesive region. The adhesive masking strip is a half ellipse having at least one groove, at least part of the wall of which groove has a region inclined by an angle of less than 45° with respect to the at least one adhesive region. The at least one adhesive region of the adhesive masking strip is applied to at least part of the edge of the surface that is to be treated, by an operator guiding said strip by inserting part of at least one finger in the groove. After the treatment, the adhesive strip is detached from the surface.

10 Claims, 5 Drawing Sheets

METHOD OF MASKING, MASKING STRIP SUITED TO THE METHOD AND METHOD OF MANUFACTURING SAID STRIP

CROSS REFERENCE TO RELATED APPLICATIONS

The present application is based on French patent application number 01/01625, filed on Feb. 7, 2001, which is hereby incorporated herein by reference in its entirety and is a divisional of Ser. No. 10/067,418, filed Feb. 7, 2002, now abandoned.

BACKGROUND OF THE INVENTION

1. Field of the Invention

The invention relates to the field of masking. Masking is understood to mean a step in a method of treating a surface in which at least part of the surface that is to be treated is covered, generally temporarily, so as to spare that surface from the treatment.

The invention relates to a method of masking and to a method of painting at least part of a motor-vehicle, and also relates to an adhesive masking strip suited to said methods of masking and of painting, and to a method of manufacturing said strip.

2. Description of the Background

Methods of masking are commonly used in all kinds of industry, for example in those in which a method entails a painting step, particularly in automotive repair.

Such methods and associated adhesive masking strips are described ire particular in the following documents: EP-B-0 365 510 and EP-B-0 384 626. EP-B-0 355 510 describes a method of masking which comprises the use of an elongate, compressible and flexible wad of cellular material which is resistant to a surface treatment for masking at least part of a surface that is to be treated. The wad of cellular material is applied to the part of the surface that is to be treated and is detached after the treatment has been completed. Said wad of cellular material constitutes an adhesive masking strip. This strip is arranged along the surface that is to be treated by hand or by using a tool that allows the strip to be distributed.

It is clearly apparent from the description and from the figures that the adhesive masking strip described in that document is of roughly cylindrical or parallelepipedal geometry and that it is arranged on the surface that is to be treated using pressure applied to the exterior face of the strip, the opposite face to the adhesive face which is placed in contact with the surface that is to be treated.

EP-B-0 384 626 describes foam items made of cold-weldable foam which can be used as adhesive masking strips. As before, the geometry of these strips is roughly cylindrical and they are applied by pressing on the exterior part of the strip, on the opposite side to the adhesive-coated part.

This type of strip, although very commonly used, particularly in the field of automotive repair, has several disadvantages.

On the one hand, positioning the strip on a surface that is to be masked is made difficult by the geometry of these strips in the case of certain parts that need to be protected. The problem is that the shape of the bodywork is highly diverse and tends to be increasingly complex, particularly with the edges of bodywork parts forming curves with small radii of curvature, or even exhibiting acute angles. This being the case, it is difficult to position the adhesive masking strips defined hereinabove and to press them down at the same time in order to apply them. It is generally necessary to use several fingers of one or even two hands in order to makes theses strips follow the edges of bodywork for which protection is intended. The geometry of these strips, cylindrical or parallelepipedal, allows a limited radius of curvature and it is necessary to force the deformation of these strips, or even to cut into them in order to makes them follow a complex path.

It sometimes happens that strips fitted in this way under high stress relax and no longer follow the desired path. They then have to be detached and repositioned, which is a time-consuming operation. Furthermore, the strip does not stick as firmly to the surface that is to be treated and there is a risk that it will move, which may give rise to defects, particularly paintwork defects during subsequent surface-treatment operations.

Another problem associated with the adhesive masking strips mentioned hereinabove stems from the fact that the geometry of such a type of strip does not suit it to all the parts in a vehicle for which protection is intended. The problem is that the adhesive masking strips may be used to protect a space between a moving part and a fixed part of a vehicle. A fixed part is understood to mean the parts of the bodywork that form the structure of the vehicle, particularly the body, the fenders, the pillars and the roof, whereas the moving parts are understood to be parts which can move with respect to the fixed parts, particularly doors, a hood and a tailgate.

Now, the separation between the various fixed parts and the various moving parts differs very appreciably from one part of the same vehicle to another.

To protect part of the vehicle by masking, particularly before putting it in for painting, it is necessary to seal this space off against paint, something which as obtained by slightly compressing the adhesive masking strip arranged on a fixed or moving part against the other part, moving or fixed respectively. The adhesive masking strips described hereinabove are generally unable to suit all the spacings that may be encountered on a given vehicle, and even more so on vehicles of different types. It is therefore necessary to uses several sizes of one type of adhesive masking strip in any automotive repair shop, or even for preparing a single vehicle. For a given type of strip, the overall shape of different strip sizes is roughly identical, only the dimensions of the strips used to suit the various spacings varying. The differences in size between strips of the same type, particularly the largest dimension in the cross section of such a strip, may be as high as a factor of two. It is commonplace to find, in a repair shop, adhesive masking strips of this same type in three different sizes. This results in significant stocks and multiple handling operations.

SUMMARY OF THE INVENTION

It is an object of the present invention is to overcome the above disadvantages, particularly by allowing the adhesive masking strip to be fitted more easily, and by using a strip which can suit a wide variation of spacing between fixed parts and moving parts, for a single vehicle, or for all vehicles.

The problem of facilitating the fitting of an adhesive masking strip is solved by a method of masking at least one edge of a part of a surface that is to be treated, by using an adhesive masking strip comprising an elongate cellular material which is resistant to a surface treatment and has at least one adhesive region, and which comprises at least one groove, at least part of the wall of which has a region (or zone or area) inclined by an angle of less than 45° with respect to the adhesive region. Said strip may be applied by an operator guiding said strip by inserting at least part of at least one finger in the groove. Said adhesive masking strip is applied to at least part of the edge of the surface that is to be treated and is detached once the treatment has been completed.

The special shape of the strip allows it to be guided very easily while it is being applied to part of the surface that is to be treated. In effect, a finger (particularly a substantial part of at least one finger), particularly a thumb, may be inserted in the groove of said adhesive masking strip. The finger inserted into the groove is used to press the region of the groove which is inclined at less than 45° with respect to the adhesive region so as to fix the strip onto the surface that is to be treated and at the same time to guide the strip, by moving the finger along in the groove in such a way as to make the strip follow the desired path.

It has been found that the fact that the adhesive masking strip has a groove makes the strip considerably easier to position along a path with a small radius of curvature or having an acute angle.

Advantageously, the strip is applied by an operator constantly guiding said strip, using one or more finger(s) inserted in the groove, and the finger(s) at the same time moves (move) longitudinally along the groove and applies (apply) sufficient pressure on a part of the surface of the groove to allow at least one adhesive region of the adhesive masking strip to stick to at least part of the edge of the surface that is to be treated.

In particular, it can be made easier to guide the strip by placing at least one other finger, for example another finger of the hand having one finger which is inserted into said groove, on the outside of the strip opposite the finger that is inserted into the groove. The adhesive masking strip can thus be adhered very easily by virtue of the movement of the fingers, and this can be done in an extremely precise way.

The invention also relates to a method of painting at least part of a motor vehicle which comprises a masking step defined hereinabove.

As a general rule, and depending on the embodiment, the strip is compressed or parted (opened out), particularly by acting on the parts of the strip on each side of the groove, bringing them closer together or parting them, when using said strip, as explained hereinafter.

According to a first preferred embodiment of this method of painting, the adhesive masking strip is applied to one part of the vehicle then compressed by another part of said vehicle.

Advantageously, the adhesive masking strip is applied to a fixed part of the vehicle, particularly of the bodywork of the vehicle, and the other part which compresses said strip is on a moving part, particularly an opening leaf of the vehicle, for example a door and/or a tailgate and/or a hood.

A fixed part of the vehicle is understood to mean a part which cannot move when the vehicle is stationary, such as the body of the vehicle, for example.

A moving part of the vehicle is understood to mean a part which, when the vehicle is stationary, can be moved with respect to the fixed parts of the vehicle, for example by removal or, for example, by operating means which allow the opening of an opening leaf such as doors, hoods, tailgates, for example.

According to a second preferred embodiment, the adhesive masking strip is applied to a part of the vehicle, particularly to a fixed part, and the sides of at least one groove are parted by a second part of the vehicle, particularly a moving part. In this case, the adhesive masking strip can be slightly opened up beforehand at the groove and a part of the vehicle can be left to open the strip up further, particularly when a moving part adopts a position against a fixed part. The strip is parted and pressed against the second part facing the first. This alternative form is particularly advantageous for protecting a region lying between a hood and bodywork, on the side of the bodywork with which a windshield lies flush.

It is thus possible to prepare the vehicle efficiently during the step prior to putting it in for painting, and once the paint has dried, to remove the adhesive masking strip. Even more advantageously, one and the same masking strip can be used to mask a space between the bodywork and an opening leaf of the vehicle, whatever the opening leaf of the vehicle. The masking step is thus far easier to carry out and this results in a very appreciable time saving. Furthermore, the stock of product needed for the masking step is reduced, because just one type of adhesive masking strip is suitable for all the parts of a vehicle that need to be masked.

The invention also relates to the adhesive masking strip intended to be used for implementing the method of masking or the method of painting described hereinabove.

This adhesive masking strip comprises an elongate cellular material, resistant to a surface treatment, and at least one adhesive region which can be detached once the surface treatment has been completed, and at least one groove, at least part of the wall of which has a region inclined by less than 45° with respect to the adhesive region, into which groove at least part of a finger, particularly of a thumb, can be introduced.

The size of the groove is such that enough of a finger can be introduced into it to guide the adhesive masking strip while at the same time pressing it down in an adhesive manner onto a surface that is to be treated.

In general, the adhesive masking strip is in the form of a very elongate tape, particularly several meters long. The cross section of this tape is generally uniform along its entire length. There may be slight variations in dimension, particularly where tapes which are shorter than the finished tape have been joined together. Usually, the shape of the cross section of the uncompressed strip falls easily inside a parallelepiped, and preferably inside a half ellipse, which itself falls inside said parallelepiped.

Preferably, the adhesive masking strip comprises a single guide groove and two flanges situated one on each side of this groove, at least one of the flanges having at least one exterior adhesive region, that is to say on the opposite side of the flange to the groove.

A guide groove is understood as meaning a groove into which part, particularly a substantial part, of a finger can be inserted.

In the remainder of the text, such a guide groove will be termed "groove". This does not in any way preclude the presence of other grooves on the adhesive masking strip according to the invention having, for example, a function other than the guide function thus defined.

The interior part of the last-mentioned flange has a region inclined at an angle of less than 45°, preferably less than 30°, with respect to the exterior part of this flange on which the adhesive region lies. This angle of inclination is also advantageously non-zero, but not greater than 45° and preferably grater than 0° but not greater than 30°.

According to an advantageous alternative form, the cross section of the adhesive masking strip falls inside a parallelepiped measuring 5 to 40 mm along the side, particularly 10 to 25 mm along the side, and 3 to 40 mm in height, particularly 10 to 25 mm in height, when the strip is in the uncompressed state, and the strip is able to be compressed at least by half in one dimension (in particular in terms of height).

This alternative form is particularly well suited to the preparation of motor vehicles by masking. Uncompressed strip heights of 10 to 25 mm, particularly around 20 mm, allow such a strip to be used to mask all the spaces between fixed parts and opening parts of a motor vehicle.

The "height" of the strip is understood as meaning the dimension of the cross section of the strip on the side in which the groove is cut. In general, the height is roughly perpendicular to at least one adhesive region, this adhesive region being the one on which a finger inserted into the strip presses during the strip fitting operation.

According to an advantageous alternative form, the groove of the adhesive masking strip is a V-shaped groove with a rounded groove bottom. Likewise, the opposite side of the strip to the groove is preferably rounded. The interior part of the flange situated between the groove and an adhesive region, and the interior part of the flange situated on the other side of the groove, preferably make an angle, $\alpha+\beta$, of between 20 and 80°, particularly more than 40°, and preferably less than 70°, when the strip is not compressed.

In an even more advantageous alternative form, the groove bottom has a radius of curvature, R, of between 5 and 30 mm, preferably more than 8 mm and particularly less than. 20 mm, when the strip is not compressed.

According to another embodiment, the adhesive region of the flange situated between the groove and said adhesive region has a flat surface, and the angle, $\alpha$, of this surface with the interior part of this same flange is smaller than the angle, $\beta$, made by the interior wall of the opposite flange, situated on the other side of the groove, with the same flat surface of the adhesive region, when the strip is not compressed.

This arrangement makes the strip far easier to use for masking. It also facilitates the insertion of the finger for guidance and allows pressing down to be performed easily in order to stick it to the surface that is to be protected. There is thus a good ability to accommodate different-sized spaces that are to be masked. This configuration is very appropriate both for spaces to be masked between a fixed part and a moving part, where masking is desired with the crushing of the strip (advantageously bringing the sides of the groove closer together), and for spaces between such parts where masking is to be performed by parting the sides of the groove covered by the strip.

This configuration also has the advantage, in the case where the strip is to be crushed, of facilitating the sliding of the opposite flange to the flange on which the adhesive region is situated.

It has become apparent during testing that, according to one particularly advantageous alternative form, $\beta$ should be greater than $\alpha$ by 3° to 30°, preferably by more than, 5° and in particular by less than 15°.

In another version of the adhesive masking strip according to the invention, when the strip is compressed, the flange situated on the opposite side of the groove to the flange on which at least one adhesive region is situated protrudes with respect to the flange on which at least one adhesive region is situated. This protrusion allows excellent adaptation of the strip to the various parts of a vehicle. Tests have demonstrated that this feature is particularly advantageous and appreciated by automotive repair professionals.

It has, in certain cases, become useful to limit the above-mentioned protrusion. Thus, according to an alternative form of the invention, the flange on which at least one adhesive region is situated comprises an edge situated on the opposite side of the flange to the bottom of the groove, making it possible to block the movement of the flange when the strip is compressed. The thickness of the edge, e, is in particular between 1 and 10 mm, preferably 2 to 5 mm, when the strip is not compressed.

The various tests have also revealed that the positioning of the adhesive region is preferably situated further toward the side of the strip in which the groove has been cut than toward the other side. In particular, in cases where the adhesive masking strip comprises a single adhesive region situated on the exterior part of a flange, said adhesive region is arranged asymmetrically on the exterior part of this flange, and predominantly on the exterior part of this flange near the outer edge of this flange. In particular it is arranged over roughly two thirds of the area of the exterior part of the flange starting from the outer edge of the flange.

It has been possible to observe, during tests, that this configuration avoids depositing adhesive in regions near the outer edge of the strip, on the opposite side to the groove. This configuration is particularly advantageous because in these regions the strip adopts the shape of an arc which will gently meet at a tangent the two surfaces which hold the strip. It is found that, during a painting operation, the paint distribution is very satisfactory because this avoids a pronounced paint line which would draw too much attention to the region which has been repainted, while at the same time masking off the regions that paint must not enter. This then yields a slight over spray in this region and leads to a transition region which cannot be detected when the painting operations are complete.

The elongate cellular material used for the adhesive masking strip according to the invention is preferably a polyurethane foam: a foam based on polyester for use with organic-solvent-based paints, and a mousse based on polyether for water-based paints. Polyester-based foams by RECTICEL are suitable for these applications, particularly the foams referenced S357 and SF367D. These foams have cell sizes of the order of 500 to 1000 μm.

The polyurethane foams are able to satisfactorily withstand a surface treatment, particularly painting, and to withstand the corresponding heat treatment without damage. Painting usually involves heating the parts that are to be treated to about 70° for about 30 minutes. After this treatment and after cooling, the strip can easily be removed.

Furthermore, a polyurethane foam strip according to the invention has the advantage that it can easily be cut by hand with little deformation, and that it stretches very little when applied to a part that is to be protected, thus allowing it to be repositioned easily if need be.

The invention also relates to a method of manufacturing the adhesive masking strip according to the invention, which comprises at least the steps of manufacturing blocks of cellular material by controlled expansion; cutting tapes of cellular material from the blocks; machining the tapes of cellular material by milling (grinding) and/or cutting and/or hot deformation in order to obtain the adhesive masking strip shape; and depositing repositionable adhesive and/or at least one adhesive tape along at least part of the machined tapes of cellular material so as to form at least one adhesive region.

This method may further comprise at least one of the optional steps of removing dust by blowing and/or brushing and/or suction; depositing a dust fixative; joining-together of tapes, particularly by bonding (gluing) and/or welding; winding at least one tape of adhesive masking strip onto at least one drum to make it easier to package; or packaging at least one tape of adhesive masking strip in a parallelepipedal cardboard box.

Advantageously, the adhesive masking strip is packaged in the form of a continuous length, particularly about 30 meters long, in a parallelepipedal cardboard box.

BRIEF DESCRIPTION OF THE DRAWINGS

Other advantageous details and features of the invention will become apparent hereinafter, from the description of some exemplary embodiments of the invention with reference to the appended figures wherein.

DETAILED DESCRIPTION OF THE PREFERRED EMBODIMENTS

For reasons of clarity, the figures do not all show the various elements depicted strictly to scale.

Figure 1:
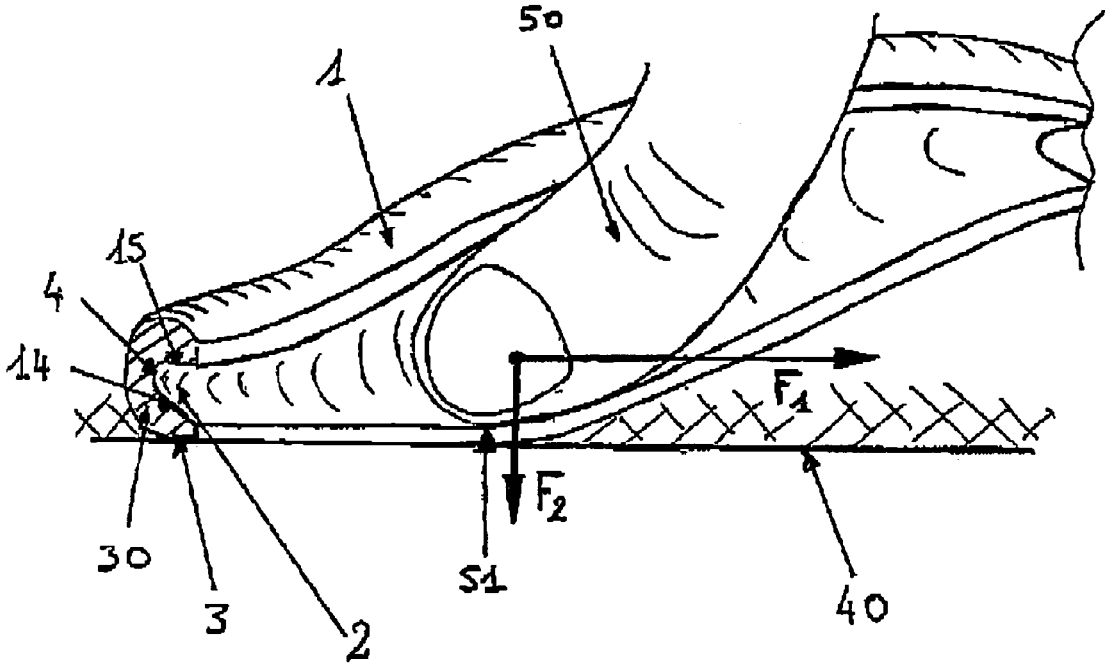
FIG. 1 shows one application of the adhesive masking strip according to an embodiment of the invention.

FIG. 1 shows one application of the adhesive masking strip, illustrating one possible implementation of the method according to the invention. This application corresponds to a step of masking in preparation for painting at least one part of a motor vehicle.

Figure 3:
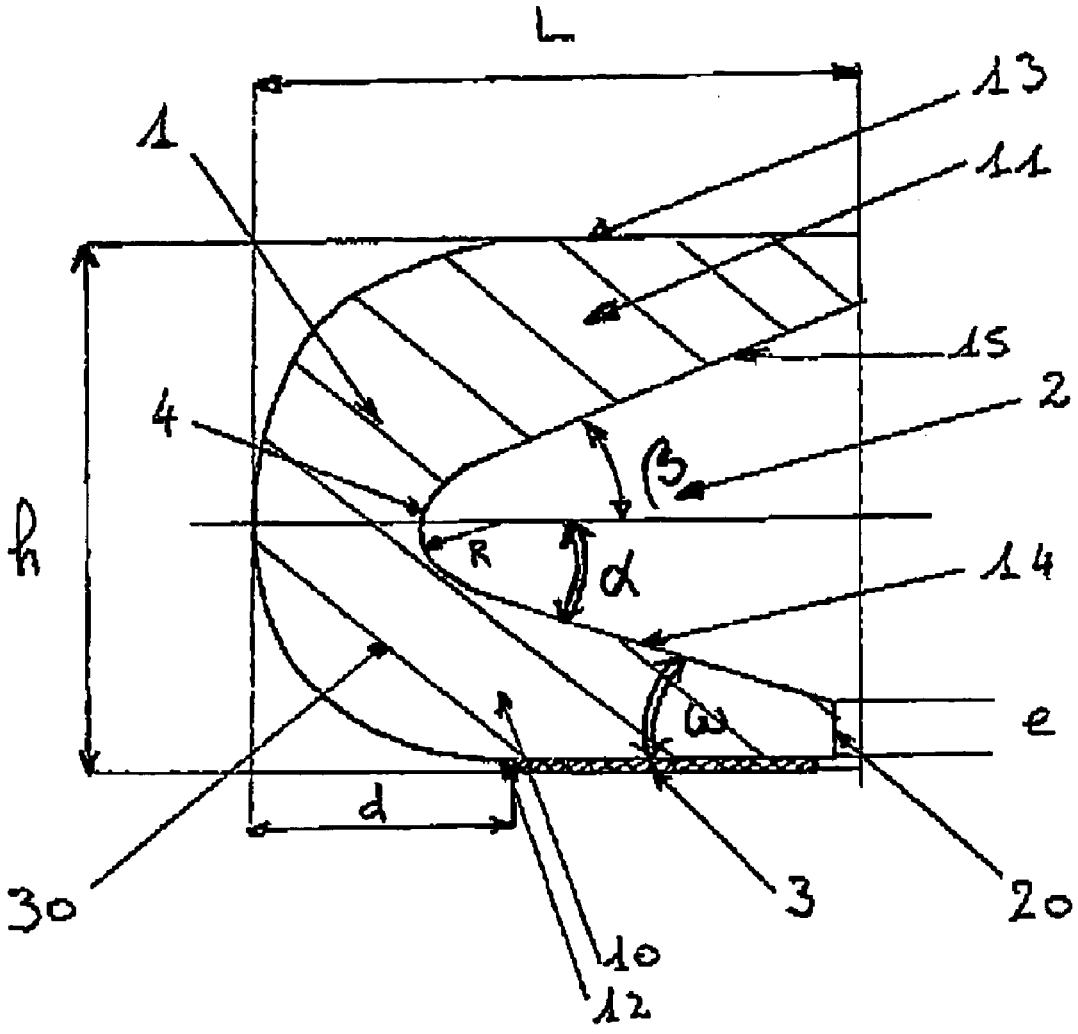
FIG. 3 is a cross section of an adhesive masking strip according to an embodiment of the invention.

In this embodiment, which is entirely non-limiting, the adhesive masking strip 1 is formed of a body of polyurethane foam having a cross section 30 roughly in the shape of a half-ellipse into which the groove 2 is cut (FIG. 3). The groove 2 is dimensioned such that a substantial part of a finger, particularly a thumb 50, can be inserted. An adhesive region 3 has been deposited over the length of the strip.

The groove has an interior surface 14 and an interior surface 15, situated one on each side of a line passing through the groove bottom 4 parallel to the adhesive strip. The interior surface 14 is the one closest to the adhesive region 3. This interior surface 14 forms an angle ω of less than 45° with respect to the adhesive region 3.

To affix this strip 1 to a surface 40 that is to be masked, a finger 50 may be introduced into the groove 2 (FIG. 1), and this finger 50 may press in the direction of the arrow $F_2$, while the finger 50 is moved along in the direction of the arrow $F_1$. This thus creates a region of contact 51 in which the adhesive region 3 of the strip sticks to the surface 40 that is to be masked. It is thus very easy both to guide the strip very precisely, for example along the edges of a complex surface, and to stick the strip down.

This method of fitting an adhesive masking strip has proved highly advantageous and tests have revealed that it is well appreciated by the users and allows them both to improve their comfort when fitting the strip and to save a very significant amount of time.

Figure 2:
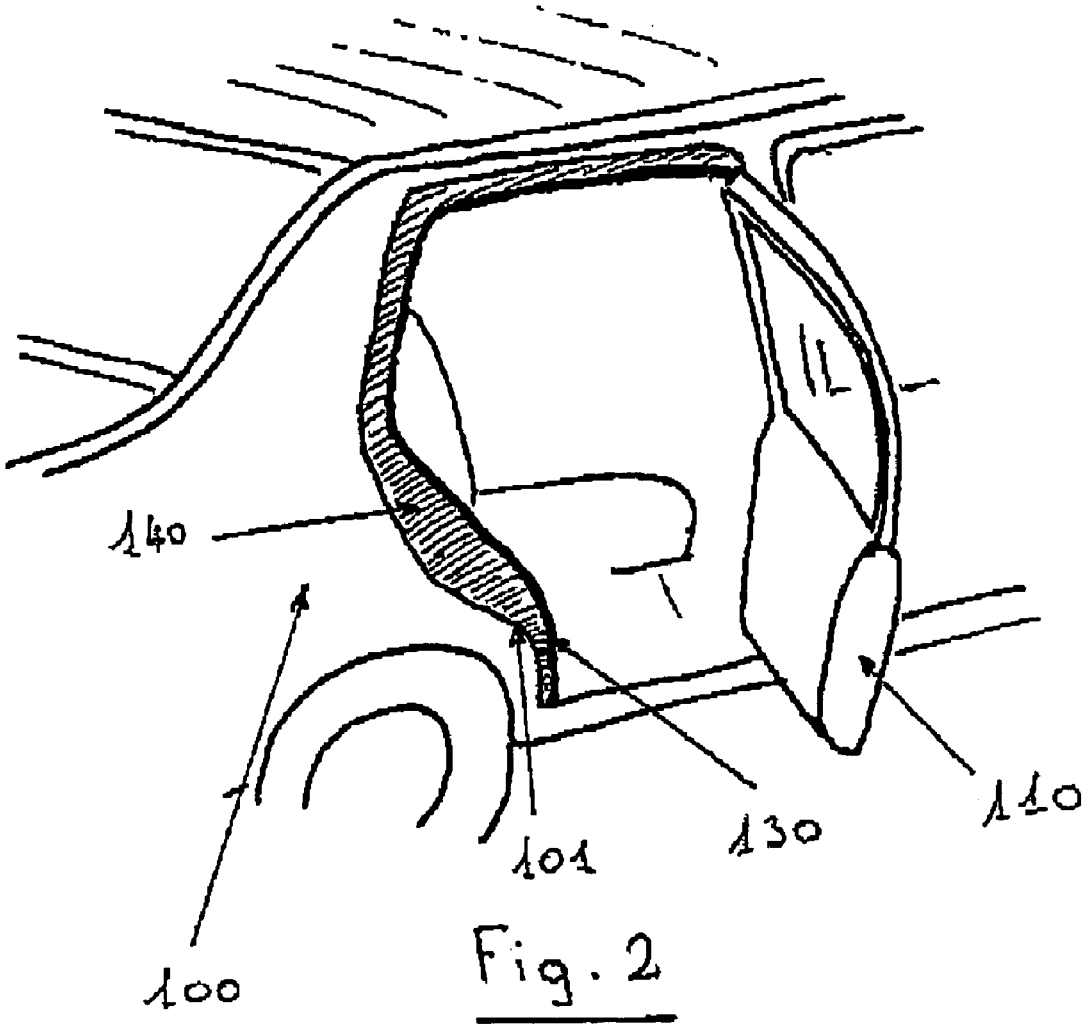
FIG. 2 shows a part of a vehicle comprising regions that are to be masked.

FIG. 2 depicts a vehicle comprising regions that are to be masked, which regions can be protected using the method according to the invention. In the case depicted, the task is one of preparing for painting a region of a vehicle comprising a door 110, which can be closed against the fixed part of the bodywork 100.

The door 110, when closed, lies flush with the outer edge of the recess 101. The bodywork has a region 140, depicted with hatching, which is masked when the door is closed. This region is delimited by a, seal 130 which provides sealing when the door is closed. When this part of the vehicle is put in for painting, it is desirable to avoid paint entering the region 140. It is therefore necessary to mask up using an adhesive masking strip arranged on the recess 101. The invention is particularly well suited to the masking of such regions.

FIG. 3 is a cross section 30 of an adhesive masking strip 1 according to the invention in the uncompressed state. The cross section of the strip 1 has roughly the shape of half an ellipse in which the groove 2 is located. The cross-section of this strip falls inside a parallelepiped of width L and height h. The strip 1 comprises two flanges 10 and 11, situated one on each side of the groove 2. These flanges 10 and 11 each have an interior surface, 14 and 15 respectively, situated on the interior wall of the groove 2, one on each side of the groove bottom 4.

The flanges 10 and 11 also each have an external surface, 12 and 13 respectively, situated on the outer side of the flanges 10 and 11. An adhesive region 3 is arranged under the external surface 12 of the flange 10. The interior surface 14 of the flange 10 makes an angle ω with the adhesive region 3, carried by the exterior surface 12 of the flange 10. The angle α that the interior surface 14 of the flange 10 makes with a plane parallel to the adhesive region 3, and passing through the bottom 14, is identical to the angle ω.

The aperture of the groove 2 is defined by the angle (α+β), which corresponds to the angle between the interior surface 14 of the flange 10 and the interior surface 15 of the flange 11. The bottom 4 of the groove 2 is rounded and has a radius of curvature R.

The two flanges 10 and 11 have roughly the same length and lie roughly flush with the edge of the parallelepiped in a heightwise direction. This configuration is non-limiting and one could instead use strips in which the length of one flange 10 or 11 is appreciably shorter than the length of the other flange.

The strip has an edge 20 situated on the flange 10 at a location opposite the bottom 4 of the groove 2. This edge 20 has a thickness e. The adhesive region 3 is situated on only part of the exterior part 12 of the flange 10, and terminates at a distance d from the surface of the parallelepiped at the bottom 4. This distance d can be expressed in relation to the width L by the parameter d/L.

Tests have been carried out using adhesive masking strips with a geometry corresponding to the strip 1 depicted in FIG. 3. The best results, in terms of the ease of affixing and effectiveness of masking for automotive paintwork were obtained with the strip characteristics (the strip being in the uncompressed state) given in Table I.

| Characteristics | Preferred ranges according to the invention | Particularly preferred ranges | Preferred values |
|---|---|---|---|
| L (mm) | 5 to 40 | 10 to 25 | 18 |
| h (mm) | 3 to 40 | 10 to 25 | 20 |
| $\omega = \alpha(°)$ | less than 45° | 10° to 35° | 25° |
| $\alpha + \beta(°)$ | 20° to 80° | 40° to 70° | 55° |
| $\beta - \alpha(°)$ | 0 to 30° | 3° to 15° | 5° |
| R (mm) | 5 to 30 | 8 to 20 | 10 |
| d/L (in %) | 0 to 90% | 20 to 50% | 33% |

Figure 4:
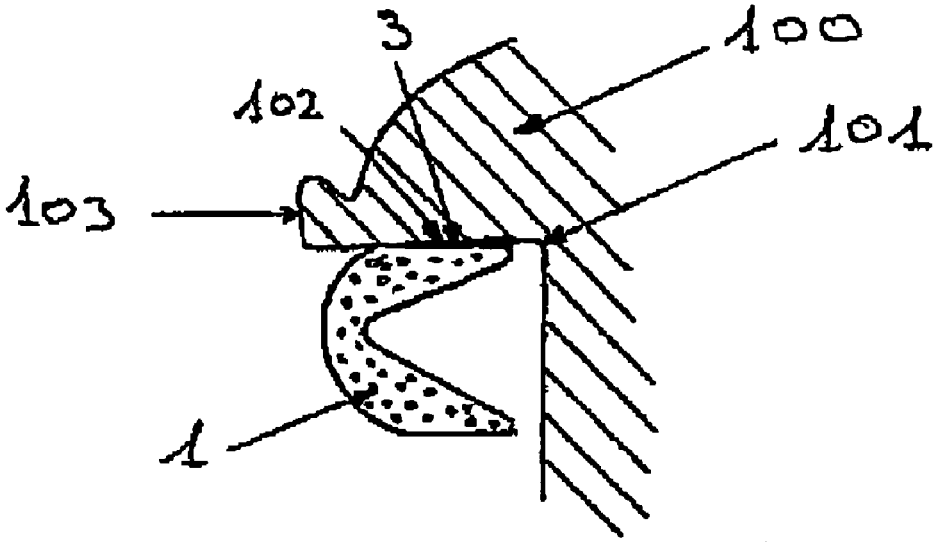
FIG. 4 shows, in section, an adhesive masking strip arranged on a fixed part of a vehicle, according to a first embodiment.

FIG. 4 depicts an adhesive masking strip 1 according to the embodiment after is has been affixed to the pillar of a vehicle door 100. The strip 1 is stuck by the adhesive region 3 to the recess 101 in the region 102 roughly perpendicular to the surface 103 that is to be painted.

Figure 5:
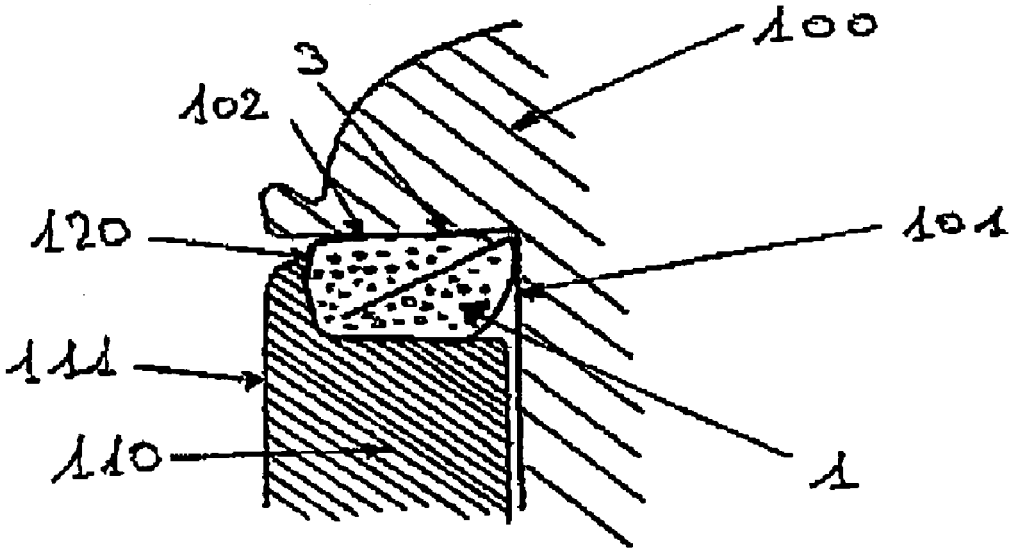
FIG. 5 is a diagram, viewed in section, of the adhesive masking strip corresponding to FIG. 4, after an opening leaf has been closed.

FIG. 5 depicts, in section, a strip 1 arranged previously according to FIG. 4, after an opening leaf, in this case a door 110, has been closed. During closure of the opening leaf, the strip 1 is crushed and occupies the space between the pillar 100 and the door 110.

Note that the flange 11, as defined in FIG. 3, is crushed and has slid along the edge 14 of the flange 10. Thus, the strip occupies a large proportion of the surface of the recess 101 in the region 102. This therefore gives excellent sealing against the paint which is sprayed onto the exterior surfaces 103 of the pillar and 111 of the door.

Note also that the strip thus affixed deforms to conform to the shape of the exterior space 120 between the pillar 100 and the door 110. The arc it forms in this region is favorable to high-quality subsequent painting. Indeed it has been possible to demonstrate that it is preferable (in this embodiment and in general according to the invention) for the strip not to form a bulge that protrudes outward (particularly out of the vehicle) in this region, because this would result in paint defects, particularly in undesired shadowing.

Figure 6:
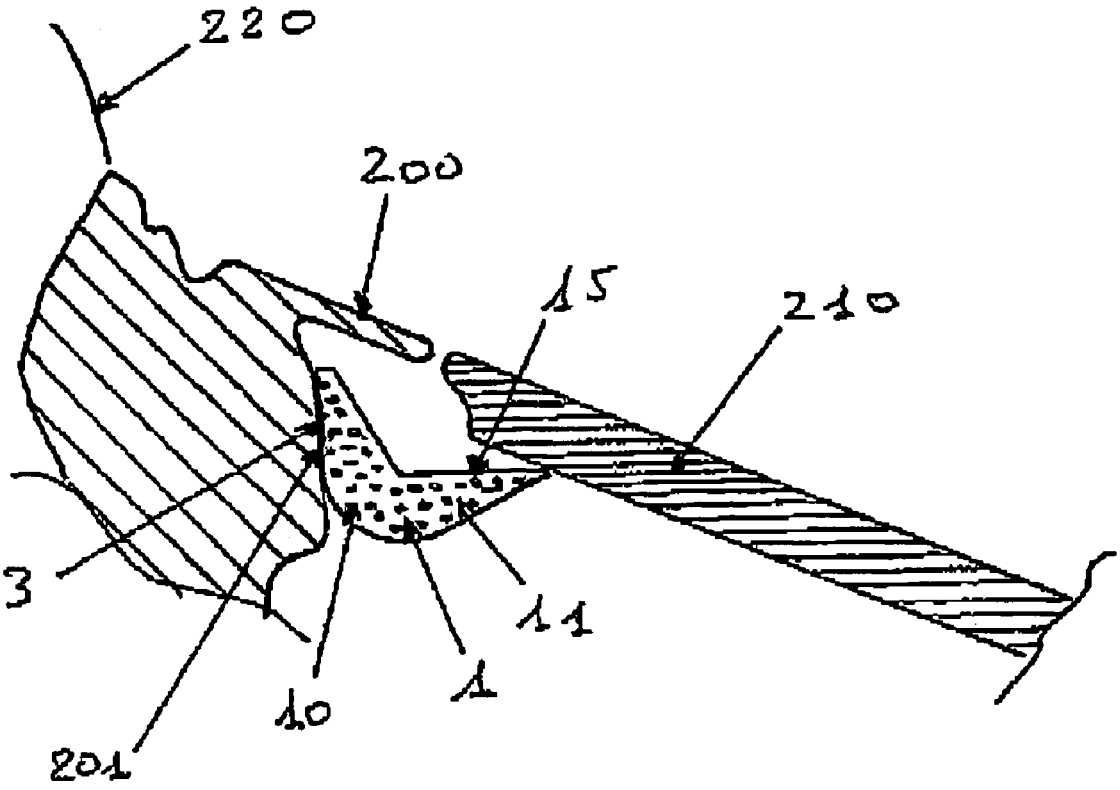
FIG. 6 is a diagram, viewed in section, of an adhesive masking strip arranged on a fixed part and after an opening leaf has been closed according to a second embodiment.

FIG. 6 depicts, in section, a strip 1 affixed to a fixed part 200, after an opening leaf 210 has been closed. This depiction corresponds to a view of a strip according to the invention arranged according to the second preferred embodiment of the method of painting described hereinabove. The fixed part 200 is a bodywork element with which a windshield 220 lies flush. The opening leaf 210 is a hood. The strip 1 is preferably arranged in such a way that the adhesive region 3 is fixed to a portion 201 of the part 200, this portion 201 lying on a surface on the same side as the bodywork facing the engine of the vehicle (not depicted here). The strip 1 is arranged in such a way that the hood 210, pressing on the flange 11 of the strip 1, opens it up. The strip 1 can be prepared by parting the two flanges 10, 11 from one another prior to closing the hood. This parting can be obtained by pressing on the interior part 15 of the flange 11 using a finger.

A region of the vehicle in which arranging a strip according to the first preferred embodiment of the invention is somewhat unsuitable can thus be prepared for painting using the same strip to mask all the parts of the vehicle that are to be protected.

Tests have in shown that with these two embodiments and with an adhesive masking strip with the geometry and dimensions defined with the preferred values of Table I, it is possible very satisfactorily to seal gaps ranging from 3 to 35 mm. The quality of the paintwork after surface treatment is remarkable and no pronounced paint lines nor regions of shadowing are found; on the contrary, there is an excellent blend between the regions of the vehicle which have been repainted and the others.

The invention is not restricted to these embodiment and is to be interpreted without limit as encompassing any method of masking at least one edge of a part of a surface that is to be treated using an adhesive masking strip comprising an elongate cellular material resistant to a surface treatment and at least one adhesive region, which comprises at least one groove, at least part of the wall of which has a region inclined by an angle of less than 45° with respect to the adhesive region, where said strip can be applied by an operator guiding the strip by inserting at least a substantial part of at least one finger in the groove, and where the adhesive masking strip is applied detachably to at least part of the edge of the surface that is to be treated and is detached after the treatment has been completed. The invention is also to be interpreted as encompassing any masking strip suited to this method of masking.

The invention claimed is:

1. A method of masking at least one edge of a part of a surface that is to be treated, comprising the steps of:

providing an adhesive masking strip comprising an elongate cellular material resistant to a surface treatment and having at least one adhesive region, wherein the adhesive masking strip comprises said material having at least one groove, at least part of the wall of said groove having a region inclined by an angle of less than 45 degrees with respect to the at least one adhesive region;

applying the at least one adhesive region of said adhesive masking strip to at least part of the edge of the surface that is to be treated, by an operator guiding said strip by inserting part of at least one finger into the groove; and detaching said adhesive masking strip after the treatment has been completed.

2. The method of masking as claimed in claim 1, wherein the strip is applied by an operator constantly guiding said strip using at least one finger inserted in the groove, and wherein the at least one finger at the same time moves longitudinally along the groove and applies sufficient pressure on a part of the surface of the groove to allow the at least one adhesive region to stick to at least part of the edge of the surface that is to be treated.

3. A method of painting at least part of a motor vehicle, comprising the steps of:

providing an adhesive masking strip comprising an elongate cellular material resistant to a surface treatment and having at least one adhesive region, wherein the adhesive masking strip comprises said material having at least one groove, at least part of the wall of said groove having a region inclined by an angle of less than 45 degrees with respect to the at least one adhesive region;

applying the at least one adhesive region of said adhesive masking strip to at least part of the edge of a surface of the motor vehicle that is to be treated, by an operator guiding said strip by inserting part of at least one finger into the groove;

performing a painting operation; and detaching said adhesive masking strip after the painting operation has been completed.

4. The method of painting as claimed in claim 3, further comprising a step of compressing the adhesive masking strip, which has been applied to one part of the vehicle, by another part of the vehicle.

5. The method of painting as claimed in claim 4, wherein the part of the vehicle to which the adhesive masking strip is applied is a fixed part of the vehicle, and wherein the another part which compresses said strip is a moving part of the vehicle.

6. The method of painting as claimed in claim 3, wherein the adhesive masking strip is applied to a fixed part of the vehicle, including the step of parting the sides of the at least one groove by a second part of the vehicle.

7. The method of painting as claimed in claim 6, wherein the same shape masking strip is used to mask both a space between the bodywork and an opening leaf of the vehicle.

8. The method of painting as claimed in claim 5, wherein the same shape masking strip is used to mask both a space between the bodywork and an opening leaf of the vehicle.

9. A method of manufacturing an adhesive masking strip comprising an elongate cellular material resistant to a surface treatment and having at least one adhesive region, wherein the adhesive masking strip comprises at least one groove, at least part of the wall of said groove having a region inclined by an angle of less than 45 degrees with respect to the at least one adhesive region, wherein said at least one groove permits insertion of a substantial part of at least one finger in the groove to guide the strip during application thereof, and which comprises the steps of:

manufacturing blocks of cellular material by controlled expansion;

cutting tapes of cellular material from the blocks;

machining the tapes of cellular material to obtain an adhesive masking strip shape; and depositing an adhesive tape along at least part of the machined tapes of cellular material so as to form at least one adhesive region.

10. The method of manufacture as claimed in claim 9, and which further comprises at least one of the following additional steps:

removing dust by at least one of blowing, brushing and suction;

depositing a dust fixative;

joining the tapes together by at least one of bonding and welding;

winding at least one tape of adhesive masking strip onto at least one drum; and packaging at last one tape of adhesive masking strip in a parallelepipedal cardboard box.

* * * * *